United States Patent [19]

Newman

[11] 4,030,384

[45] June 21, 1977

[54] RATCHET WRENCH

[76] Inventor: David P. Newman, P.O. Box 295, yellow Springs, Ohio 45387

[22] Filed: Aug. 9, 1976

[21] Appl. No.: 712,510

[52] U.S. Cl. ..... 81/58.3

[51] Int. Cl.[2] ..... B25B 13/00

[58] Field of Search ..... 81/58.3, 58, 60

[56] References Cited

UNITED STATES PATENTS

| | | | |
|---|---|---|---|
| 1,321,005 | 11/1919 | Bowman | 81/58.3 |

FOREIGN PATENTS OR APPLICATIONS

| | | | |
|---|---|---|---|
| 23,048 | 3/1921 | France | 81/58.3 |
| 577,156 | 3/1924 | France | 81/58.3 |

*Primary Examiner*—James L. Jones, Jr.
*Attorney, Agent, or Firm*—Biebel, French & Nauman

[57] ABSTRACT

A compact ratchet mechanism for box end or similar wrenches comprises a driver ring with cam teeth on one face, a driven ring rotatably confined in the driver ring and having the wrench configuration in its interior, and a pawl ring rotatably supported on the driven ring. The pawl ring has cam teeth cooperating with the driver cam teeth, and the pawl ring and driven ring have shorter interfitting teeth. The cam teeth have sufficient rise to hold the shorter teeth engaged when the driver ring is rotated one way, and to allow the shorter teeth to disengage when the driver ring is rotated the other way.

8 Claims, 9 Drawing Figures

RATCHET WRENCH

BACKGROUND OF THE INVENTION

This invention relates to ratchet wrenches, and particularly to a simplified ratchet mechanism which can be incorporated into each of a number of wrenches of graduated size.

Many ratchet mechanisms are known in the prior art, and commercially available, both for the drives of socket sets, and for individual sets of box end type wrenches. Also, a similar form of the latter type of wrench is used as an actuating handle in connection with jacking mechanism furnished with automobiles, particularly automobiles of foreign origin. In general, these mechanisms require substantial space around the box (or equivalent) wrench configuration, thus substantially increasing the size of the tool itself, and making it difficult to maneuver the tool in situations where access to a particular bolt head or nut is limited. Furthermore, such prior art ratchet mechanisms are, for the most part, characterized by swinging pawls, various actuating springs, which tend to focus stress in the mechanism, thereby limiting the force which can be applied through the mechanism to the wrench, and tending toward breakage or disability of the ratchet mechanism.

SUMMARY OF THE INVENTION

The present invention provides a novel simplified ratchet/socket mechanism which occupies only slightly more space than the conventional box end configuration of a wrench set. Thus, the ratchet feature can easily be built into a set of box end wrenches, or a set of open end/box end combination wrenches, thereby providing a ratchet feature which is particularly convenient to the mechanic when working in close quarters.

The ratchet mechanism of the invention may be attached integrally to the arm of the wrench, or may be attached to the arm through a hinged knuckle such that the access of the driven ring of the ratchet mechanism can be altered with respect to the length of the arm. The ratchet mechanism comprises a socket member, intended to mate with a nut or bolt head or with some intermediary tool, formed integrally with the driven ring, and rotatably received within a driver ring which is fastened to the arm or knuckle of the wrench handle. The driver ring is formed with a circumferentially extending driver cam projecting from one of its faces and a pawl ring surrounds the socket member of the driven ring, and is provided with a driven cam mating with the driver cam. Preferably these cams are multi-toothed to distribute forces around the mechanism, and the pawl ring and the driven ring each are provided with mating teeth. These teeth are substantially shallower in depth than the cam teeth, whereby the cam teeth when fully mated permit sufficient axial movement of the pawl ring to disengage the driving and driven ratchet teeth, thereby permitting the necessary ratcheting action of the mechanism.

The entire assembly of parts is so constructed, and of such size that the circumferential dimension of the entire mechanism is about equal in size to the normal box end wrench, and the depth or thickness of the mechanism is not appreciably greater than the thickness of the ordinary box end wrench.

The primary object of this invention, therefore, is to provide a novel ratchet mechanism, of the type described above, which may readily be incorporated into a set of wrenches such that the user will have the convenience of a ratchet mechanism in all sizes of wrench, without the need to assemble various parts for that purpose.

Other objects and advantages will be apparent from the following description, the accompanying drawings and the appended claims.

DESCRIPTION OF THE PREFERRED EMBODIMENT

Figure 1:
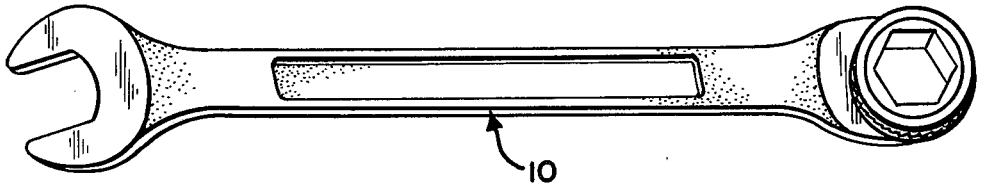
FIG. 1 is a view of a typical wrench embodying the present invention.

FIG. 1 shows a typical wrench which may be provided, incorporating the ratchet/socket mechanism of the present invention. The wrench shown is of a style popularly known as a combination open end/box end wrench, in which the ratchet socket mechanism has been substituted for the normal box end configuration. It should be understood, however, that the present invention is applicable to other forms of wrenches, and may be provided merely as a simplified driving mechanism to an adapter which can receive different sizes of sockets, or can be provided as a series of different size sockets, each with its own handle, either without any wrench combination at the opposite end, or with a different size of the same ratchet mechanism at the opposite end.

The ratchet mechanism comprises only five parts. These are the handle 10, a driver ring 12, which may be permanently fixed to the handle as by welding, or constructed as an integral part of the handle, a socket member 14 which is rotatably received within the driver ring, a pawl ring 15 which is rotatably carried on the socket member, and a retainer ring 16 which is fastened to the end of the socket member that protrudes through the driver ring, in order to retain the parts in assembled condition.

The handle 10 extends to one side of the driver ring 12, with the axis of the circular opening 20 through the driver ring being preferably at right angles to the length of the handle 10. A control cam 22 is formed on one face of the driver ring 12, preferably in the form of a set of teeth having a sloping drive face 23 and a retaining face 24 which extends in a plane parallel to, preferably intersecting, the axis of the driver ring. The cam may be formed as a single sloping surface, however the toothed configuration shown is the preferred form from the standpoint of distributing engaging forces of the mechanism around the socket member, and controlling the amount of axial force generated internally by the mechanism, tending to force apart the assembly. The pawl 15 is provided with a complementary cam 26, having like teeth of opposite configuration with retaining faces 27. The two cam surfaces, when the driven ring is rotated in a direction with a retainer face 24 leading in the direction of rotation, provide components of forces tending to move the pawl ring 15 axially away from the driver ring. With opposite rotation of the driver ring, the pawl ring can retract toward and mate into, the driver ring 12.

Figure 9:
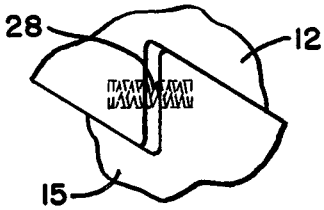

A small coil spring 28 is suitably captured between opposing teeth of the cams 22 and 26. The spring acts upon faces 24 and 27, tending to separate them. This spring is not essential, but does assist the operation of the mechanism under certain conditions, and is thus shown in FIG. 9.

The socket member 14 has a set of driven teeth 30 formed therein near that one of its ends around which the pawl ring is fitted, and the pawl ring similarly is provided with a set of driving teeth 32. These teeth when engaged transmit driving force from the driver ring through the pawl ring to the socket member 14, and thence to a bolt or nut, or intermediate member, engaged by the socket member. Preferably the teeth 30 and 32 are generally of the configuration shown, having a saw toothed shape with a sloping face and a generally vertical face which extends approximately parallel to the axis of the socket member. Thus, in one direction of relative movement (rotation) the teeth 30 and 32 will tend to engage, and in the opposite direction of movement they will disengage such that the driver ring and pawl ring can move freely relative to the socket member which may then be engaged upon a nut or the like.

Figure 4:
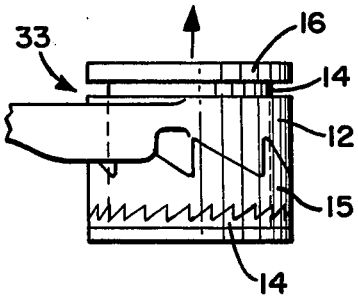
FIG. 4 is a view similar to FIG. 2 with the parts moved to show the spacing by which the driving and driven teeth may disengage.
Figure 5:
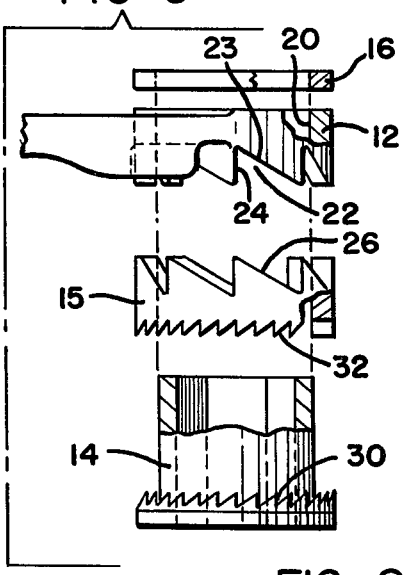
FIG. 5 is an exploded view of the parts, with some parts broken away and shown in cross-section, of the ratchet mechanism.

The depth of the teeth 30 and 32 is substantially less than the depth of the cam teeth 22 and 26, thus axial movement of the pawl ring toward and away from the driver ring, sufficient to disengage the teeth 30 and 32, will still not be enough to disengage the cam teeth. Thus, in the assembled condition, the socket member 14 extends through the pawl ring and the driver ring, and is engaged by the retainer ring 16, which (preferably) may be permanently attached to the end of the socket member, in order to capture the pawl ring therein. The length of the socket member, and the relative dimensions of the other parts, are such that with the cam teeth and the driving/driven teeth fully engaged, the space 33 between the retainer 16 and the opposite or reverse face of the driver ring 12 (as shown in FIG. 4) is slightly greater than the depth of the teeth 30, 32.

Figure 2:
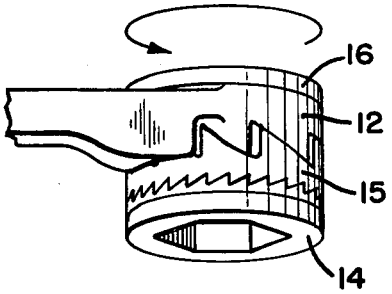
FIG. 2 is a view of the right end portion of the wrench with the parts in position for driving in clockwise direction as viewed from above.
Figure 3:
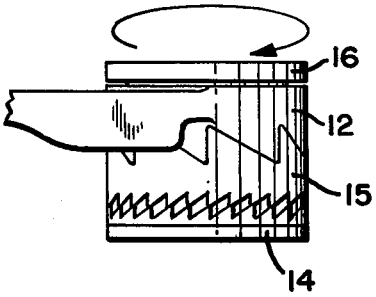
FIG. 3 is a view similar to FIG. 2 showing the parts in position for release/return motion, in a counterclockwise direction as viewed from above.

Referring to FIG. 2, if the handle 10 is rotated in a clockwise direction as shown from above, the resulting rotation of driver ring 12 will cause the cam teeth 22 to press against the cam teeth 26, assuming there is resistance to rotation of the socket member. This resistance will be provided by whatever part is engaged by the socket member. The resultant force through the cams will move the pawl ring into engagement with the teeth on the socket member, and it in turn may move slightly in an axial direction until the retainer 16 engages the opposite or reverse face of the driver ring, e.g., the condition shown in FIG. 2. With the mechanism thus locked, torque will be transmitted to the socket, and whatever part it engages, from the handle. Opposite movement of the handle, in other words counterclockwise rotation as viewed from FIG. 3 above, will release the cam mechanism, the pawl ring will tend to move toward the driver ring due to the sloping configuration of the teeth 30 and 32, and these teeth will disengage until the motion of the handle again is reversed.

It will be seen from the foregoing that the ratchet mechanism thus provided in a socket wrench or the like is simple in construction and operation, relatively easy to manufacture, and small in size such that it is not appreciably larger than an ordinary box-end wrench. If spring 28 is not used, the pawl ring 15 may have a close rotational fit to the outer surface to the socket member 14, such that there is some friction tending to resist relative movement between the two parts. Situations in use can be encountered where the tool is inverted from the position shown in FIGS. 2 and 3, and if there is resistance to movement of the socket member a slight downward pull on the handle will close the gap or space 33, while gravity will tend to cause the pawl ring to drop toward the driver ring, thereby disengaging the driving and driven teeth. However, due to the aforementioned frictional forces causing the pawl ring to resist rotation a slight movement of the handle in the forward direction will immediately cause the pawl ring to rise, engaging the driving and driven teeth. This close frictional fit is not essential since the viscosity of a lubricating material may provide adequate resistance to rotation of the user of the tool could force the engagement of the driving and driven teeth merely by lifting upwardly slightly on the handle. However, it is desirable from the standpoint of ease of operation that the user does not have to adjust for manipulation of the wrench in certain situations.

Figure 8:
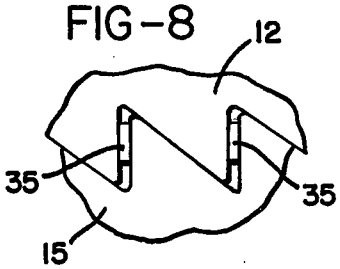
FIGS. 8 and 9 are enlarged partial views of the cams of the ratchet mechanism, showing other embodiments.

Depending upon relative size, the desirability for tooth hardness, particularly in the tip regions, and other factors such as manufacturing cost and/or complexity, it may be desirable to incorporate spring 28, or use the modification shown in FIG. 8. This modification simply adds one or more small resilient pads 26 or blocks 35 to engage between the retaining faces of the cam surfaces. When these blocks are compressed upon disengagement of the teeth 30, 32 they will tend, upon overriding of the teeth, to urge the pawl ring into engagement with the socket member, thus providing a positive force tending initially to seat the driving and driven teeth 32 and 30 before torque is applied to the handle, in the same manner as spring 28.

Figure 6:
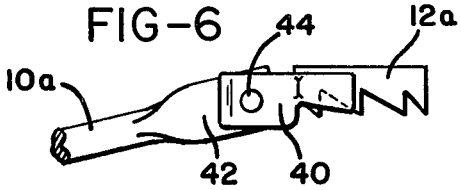
FIG. 6 is a view of a modification showing a pivot connection between the driver ring and the handle of the wrench.
Figure 7:
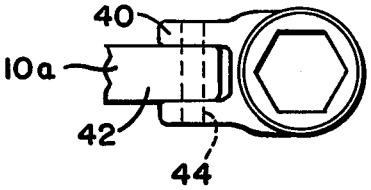
FIG. 7 is a top view of the modification shown in FIG. 6.

FIGS. 6 and 7 show a further embodiment in which a wrist action is provided for the ratchet mechanism. In this arrangement, the driver ring **12*a* includes outwardly extending arms or lugs 40 which fit between a knuckle 42 formed on the ends of the handle 10*a*. A hinge pin 44 extends through the arms of the knuckle and the lug 40, providing a hinged arrangement which may be desirable for versatility when the tool is used in close quarters. Preferably the pin 44 is fitted tightly to the knuckle and to the lug 40**, such that the ratchet end will maintain any selected angular relation to the handle.

While the forms of apparatus herein described constitute preferred embodiments of this invention, it is to be understood that the invention is not limited to these precise forms of apparatus, and that changes may be made therein without departing from the scope of the invention.

I claim:

1. A hand operated ratchet wrench comprising an an elongated body providing a handle,
a driver ring fastened to said body and having opposite faces and a circular opening located on an axis transverse to the length of said body,
a circumferentially extending driver cam projecting from one face of said driver ring,
a socket member having an outer circular configuration matched to said opening and an inner configuration of irregular shape,
said socket member being rotatably fitted within said driver ring,
a series of driven teeth on said socket member having tooth faces formed with a slope opposite to said driver cam and located facing toward but spaced from said driver cam,
a pawl ring surrounding said socket member and having a circumferentially extending driven cam engaged with said driver cam on said driver ring,
said pawl ring also having a series of driving teeth engageable with said driven teeth,
said cams having a rise greater than the depth of said teeth,
and a retainer on said socket member extending in opposed relation to the other face of said driver ring,
said retainer, said pawl ring, said teeth and said cams being spaced apart such that rotation of said driver ring in one direction will cause said cams to separate and impart engaging force to said teeth and rotation of said driver ring in the opposite direction will permit said cams to close and allow said teeth to disengage for free rotation of said socket member in said driver ring.

2. A wrench as defined in claim 1, wherein said cams comprise sets of teeth each having a sloping face and a retaining face extending parallel to said axis to distribute the engaging force from said cams around said driving teeth.

3. A wrench as defined in claim 2, including a resilient member located between the retaining faces of at least two interengaged cam teeth.

4. A wrench as defined in claim 1, including a pivot connection between said body and said driver ring, said connection including a hinge pin extending transversely to the length of said handle and to said axis of said driver ring.

5. A wrench as defined in claim 1, wherein said driven teeth are integral with said socket member, and said pawl ring includes an inner bearing surface frictionally engaging the outer circular surface of said socket member for confined axial and rotational movement thereon.

6. A hand operated ratchet wrench comprising
a handle
a circular driver ring attached to said handle so as to be rotated about its axis in response to swinging motion of said handle,
a socket member rotatably held in said driver ring and having an internal cavity of irregular shape,
a retainer limiting axial movement between said socket member and said driver ring,
a pawl ring surrounding said socket member and captured between said driver ring and said socket member,
a first set of intermeshing teeth on said socket member and said pawl ring respectively,
a second set of cooperating teeth on said pawl ring and said driver ring,
one of the sets of teeth having a rise greater than the depth of the other set of teeth allowing said pawl ring only limited rotational and axial motion with respect to said socket member, whereby motion of said handle tending to part said one set of teeth will engage the other set of teeth and rotate said socket member, and opposite motion of said handle will allow the one set of teeth to move in a mating direction and withdraw the other set of teeth from engagement.

7. A wrench as defined in claim 6, wherein said internal cavity extends through said socket member and is accessible from both faces thereof for engagement with an item to be rotated, whereby the one way drive action of the wrench can be reversed by inverting the engagement of the item with said socket member.

8. A wrench as defined in claim 7, including a pivot connection between said handle and said driver ring, said pivot connection extending in a plane transverse to the axis of said driver ring.

* * * * *